US007536761B2

(12) United States Patent
Nestler et al.

(10) Patent No.: US 7,536,761 B2
(45) Date of Patent: May 26, 2009

(54) DEVICE AND METHOD FOR SPREADING A CARBON FIBER HANK

(75) Inventors: Juergen Nestler, Chemnitz (DE); Frank Vettermann, Jahnsdorf (DE); Dietmar Reuchsel, Chemnitz (DE)

(73) Assignee: Karl Mayer Malimo Textilmaschinenfabrik GmbH, Chemnitz (DE)

( * ) Notice: Subject to any disclaimer, the term of this patent is extended or adjusted under 35 U.S.C. 154(b) by 92 days.

(21) Appl. No.: 11/550,593

(22) Filed: Oct. 18, 2006

(65) Prior Publication Data

US 2007/0101564 A1 May 10, 2007

(30) Foreign Application Priority Data

Nov. 4, 2005 (DE) ..... 10 2005 052 660

(51) Int. Cl.
*D02J 1/20* (2006.01)
*D02J 1/18* (2006.01)
*D01D 11/02* (2006.01)

(52) U.S. Cl. ..... 28/282; 28/220

(58) Field of Classification Search ..... 28/282, 28/283, 281, 247–249, 219, 220, 240, 246; 26/99, 106, 51, 51.4, 51.5; 19/66 T, 65 R, 19/66 R, 65 A, 296, 300, 299; 264/484, 483, 264/485; 361/225; 57/2.3, 90, 309; 162/192
See application file for complete search history.

(56) References Cited

U.S. PATENT DOCUMENTS 2,825,199 A * 3/1958 Hicks, Jr. ..... 57/315
3,312,052 A * 4/1967 Shiranezawa et al. ..... 57/2
3,338,992 A * 8/1967 Kinney ..... 264/441
3,358,436 A * 12/1967 Niina e tal. ..... 57/7
3,384,944 A * 5/1968 Medeiros et al. ..... 425/66
3,394,435 A * 7/1968 Knee ..... 19/299
3,456,156 A * 7/1969 Kilby et al. ..... 250/325
3,612,819 A * 10/1971 Gibson ..... 219/155
3,657,871 A * 4/1972 Uchiyama et al. ..... 57/90
3,691,009 A * 9/1972 Orderbeck ..... 162/146
3,704,485 A 12/1972 Hall
3,711,898 A * 1/1973 Debbas ..... 19/299
3,969,885 A * 7/1976 Anahara et al. ..... 57/6
4,714,642 A 12/1987 McAliley et al.
5,042,111 A 8/1991 Iyer et al.
5,590,449 A * 1/1997 Chehab et al. ..... 28/240
6,049,956 A 4/2000 Lifke et al.

FOREIGN PATENT DOCUMENTS

AU 423846 5/1972
DE 1719544 8/1971

* cited by examiner

*Primary Examiner*—Amy B Vanatta
(74) *Attorney, Agent, or Firm*—Greenblum & Bernstein, P.L.C.

(57) ABSTRACT

Device and method for spreading a carbon fiber hank into a carbon fiber band. The device includes a heating device having at least two electrodes that are spaced apart from each other and coupled to a power supply, and a spreading device arranged after the heating device in the traveling direction of the carbon fiber hank.

14 Claims, 1 Drawing Sheet

DEVICE AND METHOD FOR SPREADING A CARBON FIBER HANK

CROSS-REFERENCE TO RELATED APPLICATIONS

The present application claims priority under 35 U.S.C. § 119 of German Patent Application No. 10 2005 052 660.8, filed on Nov. 4, 2005, the disclosure of which is expressly incorporated by reference herein in its entirety.

BACKGROUND OF THE INVENTION

1. Field of the Invention

The invention relates to a device for spreading a carbon fiber hank into a carbon fiber band with a heating device and a spreading device arranged after the heating device in the traveling direction of the carbon fiber hank. Furthermore, the invention relates to a method for spreading a carbon fiber hank into a carbon fiber band, in which the carbon fiber hank is heated and then spread.

2. Discussion of Background Information

Carbon fibers are often used for producing fiber-reinforced plastic materials. Carbon fibers have a relative low mass with a relatively high tensile strength in their longitudinal direction. Carbon fibers are often embedded in a plastic matrix. If there are several layers of carbon fibers running in different directions in a matrix of this type, the increased tensile strength and thus the improved load can also be present in several directions.

Carbon fibers are generally supplied by the manufacturer in the form of carbon fiber hanks. These carbon fiber hanks are often wound on bobbins. Sometimes they are also placed in containers. The carbon fiber hanks are generally much too thick for the production of a composite material. For the production of a carbon fiber-reinforced composite material, it is generally desirable to have the individual carbon fibers lying mainly next to one another and in a few layers one on top of the other. The process is therefore that first a carbon fiber hank is spread and the carbon fiber band thus produced is fed with a weft insertion or laying device to a machine, e.g., a warp knitting machine with weft insertion or a multiaxial machine, which forms a fabric from respectively a plurality of carbon fiber bands arranged next to one another. Several groups of carbon fiber bands are thereby generally arranged in different orientations one on top of the other, e.g., in the form of a 0° layer, a 90° layer, a +45° layer and a −45° layer. The spreading and the laying of the carbon fiber bands are known per se.

It is also known that the spreading of a carbon fiber hank into a carbon fiber band is much more successful if the carbon fiber hank is heated before the spreading. In the case of carbon fibers that have already been provided with a sizing or a bonding agent, heating the carbon fibers likewise leads to the sizing or the bonding agent being heated, so that the lateral adhesion of the individual carbon fibers is weakened and the carbon fibers can be expanded more easily under a pressure acting on the carbon fiber hank.

There are several ways of heating. One known possibility is to act on the carbon fiber hank with heated air. However, if the flow conditions are unfavorable hereby, heating with heated air can lead to the carbon fibers becoming entangled in the carbon fiber hank, which in turn impairs the spreading or expanding effect.

Another possibility is to guide the carbon fiber hank over heated rollers. The heat is then transferred from the heated rollers to the carbon fiber hank. Although this embodiment has proven useful in principle, it requires a relatively high use of energy, because not only the carbon fiber hank but also the entire heated rollers have to be heated. Most of the heat is emitted unused from the heated rollers into the surroundings. Moreover, it is relatively difficult to react quickly to changes because of the thermal inertia of the heated rollers, e.g., to changes in the speed of the carbon fiber hanks. This can entail the carbon fiber hanks being overheated or not heated enough.

SUMMARY OF THE INVENTION

The present invention makes it possible to spread carbon fiber hanks in a simple manner.

According to the invention, a device of the type mentioned at the outset includes a heating device having at least two electrodes arranged spaced apart from one another, against which the carbon fiber hank bears during its movement to the spreading device. In this way, the electrodes are connected to a power supply.

The power supply generates a potential difference between the electrodes. The carbon fiber hank contains electrically conducting carbon fibers. The electrical conductivity, together with the potential difference or voltage between the electrodes, leads to a current flow through the carbon fibers. Due to the ohmic resistance of the carbon fibers, the electric current causes an electric power loss in the carbon fibers, which is converted into heat and leads to the desired increased temperature of the carbon fiber hank. The energy consumption is thereby relatively low, because only the current flow needed for heating has to be generated. It is not necessary to heat other machine parts. The sizing adhering to the carbon fibers is also heated through the heating of the carbon fibers. Thus, a major impediment to spreading or expanding a carbon fiber hank can be counteracted in a targeted manner. A specific temperature level can be set relatively precisely through the selection of the current strength in the carbon fiber hank. In the event of changes in ambient conditions or operating conditions, the current strength can be changed relatively quickly so that it is possible to react quickly to changes. The thermal inertia is relatively low. Since the carbon fiber hank is drawn off continuously in normal operation, in practice the thermal inertia can be disregarded. Since only a small section of the carbon fiber band is heated, only a relatively small mass needs to be heated. As stated above, this in turn leads to low energy consumption in operation.

Preferably, the electrodes are arranged alternately on different sides of the carbon fiber hank. This has several advantages. On the one hand, the carbon fiber hank can be guided in an S-shaped manner between the electrodes. In turn this means that the carbon fiber hank bears against the electrodes with a certain mechanical tension, so that the contact resistance is improved and the current flow is facilitated. On the other hand, it is possible to contribute to an initial expanding of the carbon fiber hank through the mechanical pull that acts on the carbon fiber hank. In turn this means that a larger area of the carbon fiber hank bears against the electrodes and thus the passage of the current is facilitated.

Preferably, at least one electrode is embodied as a deflection device. A deflection device is provided to change the direction of the carbon fiber hank. The deflection angle does not need to be large hereby. However, it should be sufficient to make it possible to apply sufficient mechanical tension to the carbon fiber hank.

The electrodes preferably have a cylinder jacket shape at least in one contact area with the carbon fiber hank. It is ensured in a simple manner, depending on the radius of the corresponding cylinder, that the mechanical load on the carbon fiber hank and the carbon fibers contained therein remains low. The carbon fiber hank is therefore not bent.

The carbon fiber hank preferably bears against more than two electrodes. In this manner, a first electrode in the traveling direction and a last electrode in the traveling direction lie on the same electric potential. This is a simple way of ensuring that the carbon fiber hank has the same electric potential outside the heating device.

This is advantageous in particular when the potential corresponds to an ambient potential. It is therefore ensured that electric current can flow only within the heating device. The ambient potential is, e.g., the potential on which the successive band contacts also lie, i.e., the contact points of the carbon fiber band with the frame of a multiaxial machine or of a warp knitting machine with weft insertion. The bobbin frame from which the carbon fiber band is drawn off also has the same potential, namely generally the so-called "earth or ground potential." If it is ensured that the first and the last electrode lie on the ground or earth potential, then there will be no additional current flow outwards.

Preferably, the carbon fiber hank is guided over the electrode with friction. This has the advantage that the electrode is cleaned by the carbon fiber band itself. Lint formation is thus counteracted. A virtually unchanged contact resistance can thus be achieved between the carbon fiber band and the electrode even with longer operation. The electrode can be stationary. It can also rotate. However, in the latter case it should be braked or driven so as to be able to generate a relative velocity between the carbon fiber hank and the electrode.

Preferably, the power supply is embodied as a constant power supply, the current strength of which is adjustable. It is therefore ensured that a constant current with an adjusted strength always flows through the carbon fibers of the carbon fiber hank. The heat fed into the carbon fiber hank and the consequent increase in temperature can thus be adjusted relatively precisely. Minor interference that can occur through different contact resistances between the carbon fiber hank and the electrode is simply but effectively eliminated. If, for example, an increased contact resistance occurs, the power supply has to increase its current temporarily in order to ensure the constant current flow. Constant power supplies are commercially available at reasonable prices.

The power supply is preferably connected to a sensor arrangement that detects at least one predetermined actual parameter of the carbon fiber hank and/or of the carbon fiber band, whereby the power supply is regulated such that this actual parameter agrees with a predetermined desired parameter. A passive regulation of the expanding operation is thus possible.

It is hereby preferred for the actual parameter to be the width of the carbon fiber band in the traveling direction after the spreading device. The width of the carbon fiber band depends on the temperature. The temperature in turn depends on the current flow and the dissipated electric heat generated thereby. The determination of the width of the carbon fiber band can be carried out relatively easily and without contact. The width is ultimately the target value according to which the method is oriented. If the width can be detected directly and used as a control parameter, no other conversions are necessary.

The power supply is preferably connected to a machine control that is also connected to a band insertion device, whereby the machine control controls the power supply subject to the activity of the band insertion device. The spreading of the carbon fiber hank into a carbon fiber band can thus also be configured actively by the transmission of process data. For example, riggers that ensure a batchwise web insertion offer marked advantages. A rigger deposits, e.g., a carbon fiber band between two conveyor chains, whereby the deposit takes place only in one direction of travel of the rigger. No carbon fiber band is used on the return path of the rigger. The heating of the carbon fiber hank can now be coordinated relatively easily with the activity of the rigger, because a current flow is generated only when the carbon fiber band is actually drawn off. "Standing rows" or band markings can at least be reduced. Of course, in a case of this kind, the heating would be carried out taking into account the guidance of the carbon fiber bands and taking into account in particular the carbon fiber band segments between the heating device and the rigger in the heating of the carbon fiber hank.

Preferably, the carbon fiber hank is engaged with a band tension regulator. The transition resistance between the carbon fiber hank and the electrode can thus be influenced and essentially kept constant.

The electrodes are preferably provided with a cleaning device. This cleaning device can be provided additionally or alternatively to the cleaning of the electrodes by the carbon fiber hank itself. In this way it is ensured that the contact resistance between the electrodes and the carbon fiber hank can be kept essentially constant.

Preferably the power supply generates between two electrodes a DC voltage of no more than 60V, in particular a voltage in the range of 12V to 20V. A DC voltage is relatively easy to regulate. If a voltage of no more than 60V is used, this is a SELV (safety extra low voltage) or a PELV (protective extra low voltage) in which the safety expenditure is relatively low. There is no potential danger to operators.

The invention is directed to a method of the type described at the outset in which the heating includes a current flow generated in a predetermined length of the carbon fiber hank.

The fact is therefore utilized that the carbon fibers in the carbon fiber hank are electrically conductive, because the carbon fibers at the same time represent an ohmic resistance. If a current flow through the carbon fibers is generated, at the same time a dissipated electric heat is generated, which leads to an increased temperature of the carbon fibers themselves and of the surface coatings adhering thereto, e.g., a sizing or another bonding agent. With this heating, the adhesion between adjacent carbon fibers is reduced thus creating a condition that facilitates the spreading or expanding of the carbon fiber hank. Because the heat is generated in the carbon fibers themselves, only relatively small masses need to be heated. The electric current can be changed relatively quickly. A thermal inertia is thus relatively small or is almost not present at all. The method can thus be adapted relatively quickly to changes in the operation of a machine connected to the spreading device, e.g., a multiaxial machine or a warp knitting machine with weft insertion. Comparatively little heat is dissipated into the surroundings, because it is not necessary to also heat any additional machine elements. At the most a low power dissipation occurs in the machine elements used for supplying electric power to the carbon fiber hank. However, this power loss is much lower than that of a heated roller.

Preferably, a current flow starting from one position is generated to two positions spaced apart from the position in different directions. From the "supplying" position, a current flow in the traveling direction and a current flow against the traveling direction of the carbon fiber hank are thus generated. It can thus be ensured that carbon fiber hank sections lying in front of or after the respectively last electrode in the traveling direction are electrically virtually voltage-free. No current flow is thus generated in these sections so that acting on the carbon fiber hank with electric power can be limited to clearly defined sections.

Preferably, the carbon fiber hank is mechanically tensioned via at least two electrodes. This has the advantage that the contact resistance between the carbon fiber hank and the electrodes is improved. At the same time the mechanical tension already contributes to a certain spreading which in turn enlarges the contact area between the carbon fiber hank and the electrode. This in turn improves the electrical transition between the electrodes and the carbon fiber hank, so that the electrical power loss is generated virtually exclusively in the carbon fibers of the carbon fiber hank, but not in other machine elements.

Preferably, an adjustable constant current flow is generated. The electrical power loss, and thus the temperature increase, can be adjusted relatively precisely via the current flow.

Preferably, the width of the carbon fiber band is determined after the spreading and the current strength is adjusted subject to the width obtained. The current through the carbon fiber hank is thus regulated depending on the width of the carbon fiber band.

The present invention is directed to a device for spreading a carbon fiber hank into a carbon fiber band. The device includes a heating device having at least two electrodes that are spaced apart from each other and coupled to a power supply, and a spreading device arranged after the heating device in the traveling direction of the carbon fiber hank.

According to a feature of the invention, the carbon fiber hank may contact the at least two electrodes as it travels toward the spreading device.

In accordance with another feature of the present invention, the at least two electrodes can be structured and arranged to alternately contact different sides of the carbon fiber hank.

According to still another feature, at least one of the at least two electrodes can form a deflection device.

In accordance with the instant invention, at least a contact area of the at least two electrodes for contacting the carbon fiber hank have a cylinder jacket shape.

Further, the least two electrodes can be more than two electrodes structured and arranged to contact, and a first and a last electrode, relative to the traveling direction, may be supplied with a same electrical potential. The potential can be a ground voltage. Also, electrodes between the first and last electrodes in the traveling direction may be supplied with a potential different from the ground voltage.

In accordance with still another feature, the electrodes can be structured and arranged such that the carbon fiber hank is guided over the electrodes with friction.

According to another feature of the invention, the power supply can include a constant power supply having an adjustable current strength.

In accordance with a further feature of the present invention, a sensor arrangement may be structured and arranged to detect at least one predetermined parameter of at least one of the carbon fiber hank and the carbon fiber band. The power supply can be connected to the sensor arrangement and the power supply may be regulated to control the at least one predetermined parameter.

The at least one predetermined parameter can be a width of the carbon fiber band in the traveling direction after the spreading device.

Moreover, the power supply may be connected to a machine control that is also connected to a band insertion device. In this manner, the machine control controls the power supply subject to the activity of the band insertion device.

The invention can further include a band tension regulator that is engagable with the carbon fiber hank.

According to another feature, the device may include a cleaning device coupled to the at least two electrodes.

According to the invention, the power supply can generate between the at least two electrodes a DC voltage of no more than 60V.

The instant invention is directed to a method for spreading a carbon fiber hank into a carbon fiber band. The method includes supplying a current flow through a predetermined length of the carbon fiber hank, and spreading the predetermined length after the current flow.

According to a feature of the invention, the current flow heats the carbon fiber hank.

Further, the current flow may be generated from a first position to two other positions that are spaced from each other starting and in opposite directions from the first position.

In accordance with another feature of the invention, the method can include mechanically tensioning the carbon fiber hank over at least two electrodes.

Moreover, the current flow can be an adjustable constant current flow.

In accordance with still yet another feature of the present invention, the method can further include adjusting a magnitude of the current flow to control a width of the carbon fiber band after the spreading.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
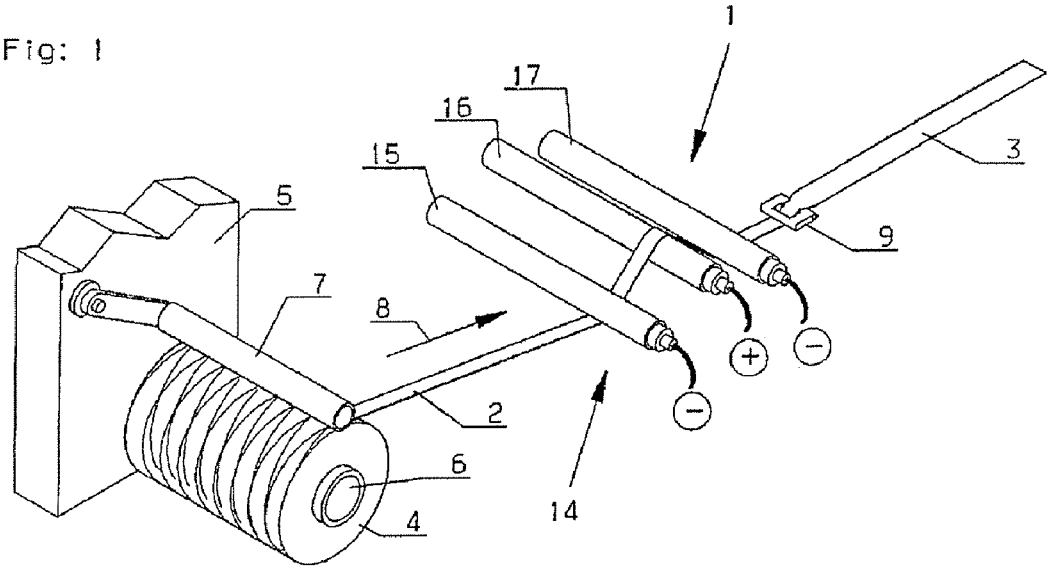
FIG. 1 illustrates a diagrammatic, perspective representation of a device for spreading a carbon fiber hank.

FIG. 1 shows a device 1 for spreading a carbon fiber hank 2 into a carbon fiber band 3. The carbon fiber hank 2 is wound on a bobbin 4 that is pivoted in a creel frame 5 on a shaft 6 attached there. The bobbin 4 can be braked in the creel frame 5 in a manner known per se but not shown in further detail. A pressure device 7 acts on the bobbin 4, which device can additionally fulfill the function of a "level indicator."

A carbon fiber hank contains several thousand individual carbon fibers, e.g., 12000 (12 K) or 24000 (24 K) carbon fibers, which are combined in the manner of a bundle. The carbon fibers are generally provided with a surface coating, e.g., a sizing. This surface coating leads to an adhesion of the individual carbon fibers among one another.

Figure 2:
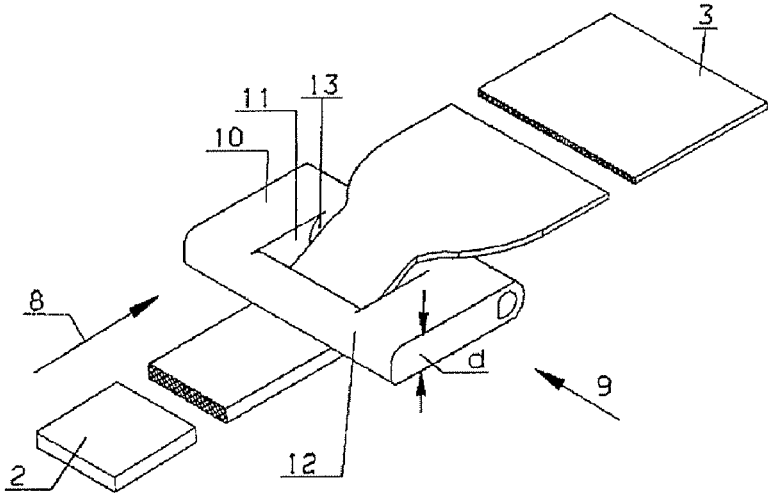
FIG. 2 illustrates an enlarged representation of a spreading device and FIG. 3 illustrates a diagrammatic representation of the embodiment of the spreading device in a processing machine.

For the further processing, a carbon fiber hank 2 is now to be spread out crosswise to its traveling direction 8. To this end a spreading device 9 is provided, which is shown enlarged in FIG. 2.

The spreading device 9 has a plate 9 with an opening 11. The width of the opening 10 crosswise to the traveling direction 8 basically defines the maximum later width of the carbon fiber band 3.

In the traveling direction 8, the opening 11 is limited by a first deflection device 12 and a second deflection device 13. The carbon fiber hank 2 is guided alternately first under the first deflection device 12 and over the second deflection device 13 in order to maintain a certain tension by a pull on the carbon fiber band 3. The two deflection devices 12 and 13 have a relatively small spacing in the traveling direction 8, so that even with a relatively small thickness of the plate 10 a sufficient spreading or expanding of the carbon fiber hank 2 into the carbon fiber band 3 can be achieved.

It should be noted at this point that a plurality of carbon fiber hanks 2 can be processed in a manner not shown in further detail, which hanks are drawn off from a corresponding number of bobbins 4. Then a corresponding spreading device 9 is provided for each carbon fiber hank 2, whereby adjacent spreading devices 9 are arranged next to one another such that their openings 11 connect to one another.

In order to facilitate the spreading or expanding of the carbon fiber hank 2, a heating device 14 is arranged upstream of the spreading device 9 in the traveling direction 8. In the present exemplary embodiment the heating device 14 has three electrodes 15-17, over which the carbon fiber hank 2 is guided in an S-shaped or undulating manner. In the embodiment according to FIG. 1, the carbon fiber hank 2 is guided under the first electrode 15 in the traveling direction 8, then over the second electrode 16 and in turn under the third electrode 17. The carbon fiber hank 2 is thereby kept at a certain tension. To this end a hank tension regulating device 18 is shown diagrammatically in FIG. 3, which device is a component of an unwinding device 19, which includes the creel frame 5 and the bobbin 4.

The electrodes 15-17 are embodied as cylindrical rods. They thus have a cylindrical circumferential surface against which respectively the carbon fiber hank 2 bears. However, the electrodes 15-17 are not embodied to be rotating, so that the carbon fiber hank is guided over the electrodes 15-17 with a certain friction. It is also possible for the carbon fiber hank 2 to be displaced perpendicular to the traveling direction 8 during the unwinding from the bobbin 4, thus running over the electrodes 15 through 17 in a traversing manner.

Figure 3:
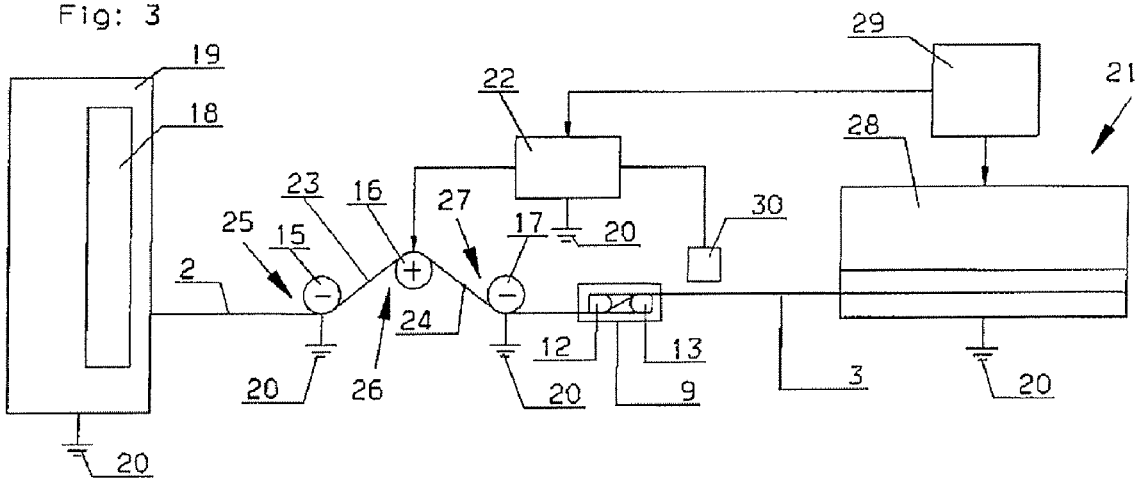

As shown by FIGS. 1 and 3, the electrodes 15-17 lie on different electrical potentials. The center electrode 16 lies on a plus potential and the two outer electrodes 16 and 17 in the traveling direction 8 lie on a minus potential that can also be called an earth or ground potential 20. The other components of the FIG. 3 device 21 for processing the carbon fiber band 3 diagrammatically shown, which are described in more detail below, also lie electrically on this ground potential 20.

To generate the individual electrical potentials and thus the potential difference between the electrode 16 and the electrode 15 on the one hand and the electrode 16 and the electrode 17 on the other hand, a power supply 22 is provided that is connected on the one hand to the electrode 16 and on the other hand to the ground potential 20, so that it is also connected to the two electrodes 15, 17 through the ground potential 20. The power supply 22 generates an electric current between electrodes 16 and 15 and between electrodes 16 and 17 that lies in the range of 12V to 20V. It is preferred for this electric current to be no more than 42V, because this is then a protective extra-low voltage in which further protective measures against contact by an operator entail only a relatively small expense.

A first section 23 of the carbon fiber hank is arranged between the electrodes 15, 16 and a second section 24 of the carbon fiber hank is arranged between the electrodes 16, 17. Both sections 23, 24 are flowed through by an electric current when the carbon fiber hank 2 bears against the electrodes 15-17. However, the current flow is in fact limited to these sections 23 and 24, because the two outer electrodes 15 and 17 in the traveling direction 8 lie on the same electrical potential as other contact points of the carbon fiber hank 2 or the carbon fiber band 3.

The current flow between electrodes 15 and 16 and between electrodes 16, 17 is possible because the carbon fibers of the carbon fiber hank 2 are per se electrically conductive. In addition, they have an ohmic resistance, so that the current flowing between the electrodes 15 and 16 and between electrodes 16 and 17 leads to an electrical power loss that is manifested by a generation of heat. The generation of heat leads to a higher temperature of the carbon fiber hank which has an effect on the surface coating of the carbon fibers and thus promotes the expanding of the carbon fiber hank 2.

The electrical properties, in particular the ohmic resistance of the carbon fibers in the carbon fiber hank, are known or can be determined beforehand by means of measurement technology. The level of the electrical power loss and thus the temperature increase that results with a certain current strength can thus also be calculated relatively easily via the level of the current flow. An adjustment of the carbon fiber hank 2 to a predetermined temperature can thus also be achieved through the control of the current strength in a very targeted manner. This temperature adjustment can be made virtually without inertia because the power supply 22 can be adjusted very quickly to predetermined current strengths. In order to reduce a negative impact of electrical transition resistances between the electrodes 15-17 and the carbon fiber hank 2, the power supply 22 is embodied as a constant power supply with an adjustable current. When the transition resistances increase, the power supply 22 must increase its output voltage in order to ensure the constant current flow.

Because the carbon fiber hank 2 is guided with a certain friction over the electrodes 15-17, it can be ensured that the electric transition resistance remains largely constant during operation. Lint deposit is thus prevented in a targeted manner or adhering lint is removed. In addition, a cleaning device 25-27, shown diagrammatically in FIG. 3, can be provided for each electrode 15-17, which cleaning device cleans off the surface of the electrodes 15-17, e.g., with the aid of a targeted air flow.

FIG. 3 shows diagrammatically the embedment of the device 1 in a device 21 for processing carbon fiber bands 3. For example, the device has a rigger 28 that also can be called a band insertion device, of a multiaxial machine or a warp knitting machine with weft insertion. With a multiaxial machine, carbon fiber bands 3 are laid next to one another in one layer. Several layers are laid one on top of the other. In each layer the carbon fiber bands have a predetermined orientation to the longitudinal extension of the web formed by the laying. For example, the orientations of the carbon fiber bands 3 in the individual layers can be 0°, 90°, +45° and −45°. The rigger 28 is controlled by a machine control 29 shown diagrammatically. The rigger 28 grips a section of a carbon fiber band 3 and deposits it between two conveyor chains. No carbon fiber band 3 is conveyed on the return path of the rigger 28. During these rest periods the heating of the carbon fiber hank 2 can also be omitted or reduced. The machine control 29 is thus connected to the power supply 22 in order to control the power supply 22 subject to the operation of the rigger 28. Band markings or "standing rows" which can currently occur with the use of heated rollers can be reduced.

Additionally or alternatively thereto a sensor 30 can be provided after the spreading device 9, which sensor determines, e.g., the width of the carbon fiber band 3 perpendicular to the traveling direction 8. The current flow generated by the power supply 22 can be regulated subject to the width obtained, so that the actual width determined corresponds to a predetermined desired width. The width obtained with the spreading device 9 depends on the strength of the current that flows through the sections 23 and 24.

The heating device 14 with the electrodes 15-17 makes it easy to quickly adjust to different operating conditions, e.g., different machine speeds of the rigger 28 of a multiaxial machine. The expanding operation can on the one hand be regulated passively, e.g., by recording a measured variable such as the width of the carbon fiber band 3 or the temperature of the carbon fiber band 3. On the other hand, the expanding operation can be structured actively by transferring process data from the multiaxial machine or another downstream machine.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for spreading a carbon fiber hank into a carbon fiber band, comprising:

a heating device including at least two electrodes that are spaced apart from each other and coupled to a power supply; and a spreading device arranged after the heating device in the traveling direction of the carbon fiber hank, wherein the at least two electrodes comprises more than two electrodes structured and arranged to contact the carbon fiber hank, and a first and a last electrode, relative to the traveling direction, are supplied with a same electrical potential, and wherein electrodes between the first and last electrodes in the traveling direction are supplied with a potential different from a ground voltage.

2. The device in accordance with claim 1, wherein the electrodes are structured and arranged such that the carbon fiber hank is guided over the electrodes with friction.

3. The device in accordance with claim 1, wherein the power supply comprises a constant power supply having an adjustable current strength.

4. The device in accordance with claim 1, further comprising a sensor arrangement structured and arranged to detect at least one predetermined parameter of at least one of the carbon fiber hank and the carbon fiber band, wherein the power supply is connected to the sensor arrangement and the power supply is regulated to control the at least one predetermined parameter.

5. The device in accordance with claim 1, wherein the carbon fiber hank contacts the at least two electrodes as it travels toward the spreading device.

6. The device in accordance with claim 1, wherein the at least two electrodes are structured and arranged to alternately contact different sides of the carbon fiber hank.

7. The device in accordance with claim 1, wherein at least one of the at least two electrodes comprises a deflection device.

8. The device in accordance with claim 1, wherein at least a contact area of the at least two electrodes for contacting the carbon fiber hank have a cylinder jacket shape.

9. A device for spreading a carbon fiber hank into a carbon fiber band, comprising:

a heating device including at least two electrodes that are spaced apart from each other and coupled to a power supply;

a spreading device arranged after the heating device in the traveling direction of the carbon fiber hank; and a sensor arrangement structured and arranged to detect at least one predetermined parameter of at least one of the carbon fiber hank and the carbon fiber band, wherein the power supply is connected to the sensor arrangement and the power supply is regulated to control the at least one predetermined parameter, and wherein the at least one predetermined parameter is a width of the carbon fiber band in the traveling direction after the spreading device.

10. The device in accordance with claim 9, wherein the power supply is connected to a machine control that is also connected to a band insertion device, whereby the machine control controls the power supply subject to the activity of the band insertion device.

11. The device in accordance with claim 9, further comprising a band tension regulator that is engagable with the carbon fiber hank.

12. The device in accordance with claim 9, further comprising a cleaning device coupled to the at least two electrodes.

13. The device in accordance with claim 9, wherein the power supply generates between the at least two electrodes a DC voltage of no more than 60V.

14. A method for spreading a carbon fiber hank into a carbon fiber band in the device in accordance with claim 9, comprising:

supplying a current flow through a predetermined length of the carbon fiber hank; and spreading the predetermined length after the current flow; and adjusting a magnitude of the current flow to control a width of the carbon fiber band after the spreading.

* * * * *